United States Patent [19]

Russer

[11] 4,008,541

[45] Feb. 22, 1977

[54] TOY PARACHUTE

[76] Inventor: Martin R. Russer, P.O. Box 5564, Santa Barbara, Calif. 93108

[22] Filed: July 28, 1975

[21] Appl. No.: 599,933

[52] U.S. Cl. ..... 46/86 R

[51] Int. Cl.[2] ..... A63H 33/20

[58] Field of Search ..... 46/39, 86 R, 86 A–86 C

[56] References Cited

UNITED STATES PATENTS

| | | | |
|---|---|---|---|
| 2,199,163 | 4/1940 | Quady | 46/86 R |
| 2,321,904 | 6/1943 | Frazier | 46/86 R |
| 3,175,327 | 3/1965 | Wend | 46/86 R |
| 3,798,829 | 3/1974 | Worley | 46/86 R |

*Primary Examiner*—G.E. McNeill
*Assistant Examiner*—Robert F. Cutting
*Attorney, Agent, or Firm*—James E. Hawes

[57] ABSTRACT

The disclosed parachute toy, preferably an accessory for a toy doll figure, includes a backpack container within which is packed a parachute attached by shroud lines to an ejection mechanism. In one embodiment, the ejection mechanism is designed to provide a time delayed expulsion of the parachute, while in another embodiment a pull cord is provided to actuate ejection of the parachute.

10 Claims, 6 Drawing Figures

TOY PARACHUTE

INTRODUCTION

The invention relates to a parachute toy, particularly a parachute toy adapted to be attached to a toy doll figure. The toy is intended to eject the parachute after being thrown high in the air, the ejected parachute causing the toy to drift slowly to earth.

The essential characteristics of any toy, in addition to its basic appeal as a toy, include ruggedness, simplicity of operation, and reliability of performance all in an economic unit. Various parachute toys have been designed in attempts to achieve these essential features. One group of such parachute toys includes elements designed to be projected upward by an accessory such as a slingshot or gun; other parachute toys are designed to be thrown upward. Some of these toys incorporate timing mechanisms for ejecting the parachute, other of the toys simply are intended to be gravity oriented and deploy the parachute at approximately the apogee of their flight. It is clear that those toys which best simulate the operation of the article after which they are modeled, or which require some appreciable skill in use, offer the maximum appeal and result in maximum success. To date, achieving such objectives with a simple parachute toy appears to have eluded the ingenuity of toy designers, for parachute toys have not met with appreciable success in spite of their obvious inherent appeal.

BRIEF SUMMER OF THE INVNTION

The parachute toy provided by the invention is designed to be attached to a toy figure as a backpack unit, thereby best simulating the operation of a sport parachutist in descent. However, the toy may be used independently of such a figure if desired, since it does not require the presence of such a figure in any respect.

The structure of the parachute toy includes a container with a pop-off lid. Within the container is an ejection mechanism that incorporates a piston which, when actuated, ejects the parachute from the container, popping off the lid, the parachute being attached to the toy by shroud lines. The piston of the ejection mechanism is driven by a spring which is released by a triggering device, the spring and toy being designed and configured to rapidly and powerfully eject the parachute from the container producing a definite "pop". Such action is important to the appeal of the toy.

In one embodiment, the triggering device includes a suction cup which holds the piston to the floor of the container. Upon unlatching the triggering device, the hold of the suction cup is gradually released as the suction diminishes until finally it is broken and the spring freed to power the ejection action. Upon depressing the piston within the container, the suction cup is reset against the base of the container and the piston relatched to the side of the container.

In another embodiment, the triggering device consists simply of a latch which restrains the ejection of the parachute by the piston until delatched. The latch is actuated by a clip being pulled by a string past the latch, camming it outwardly and releasing the piston. This triggering pull is applied by the user employing a string of a length approximating the height at which actuation of the parachute is desired.

BRIEF DESCRIPTION OF THE DRAWINGS

The invention will be further described in connection with the accompanying drawings in which.

DETAILED DESCRIPTION OF THE INVENTION

Figure 1:
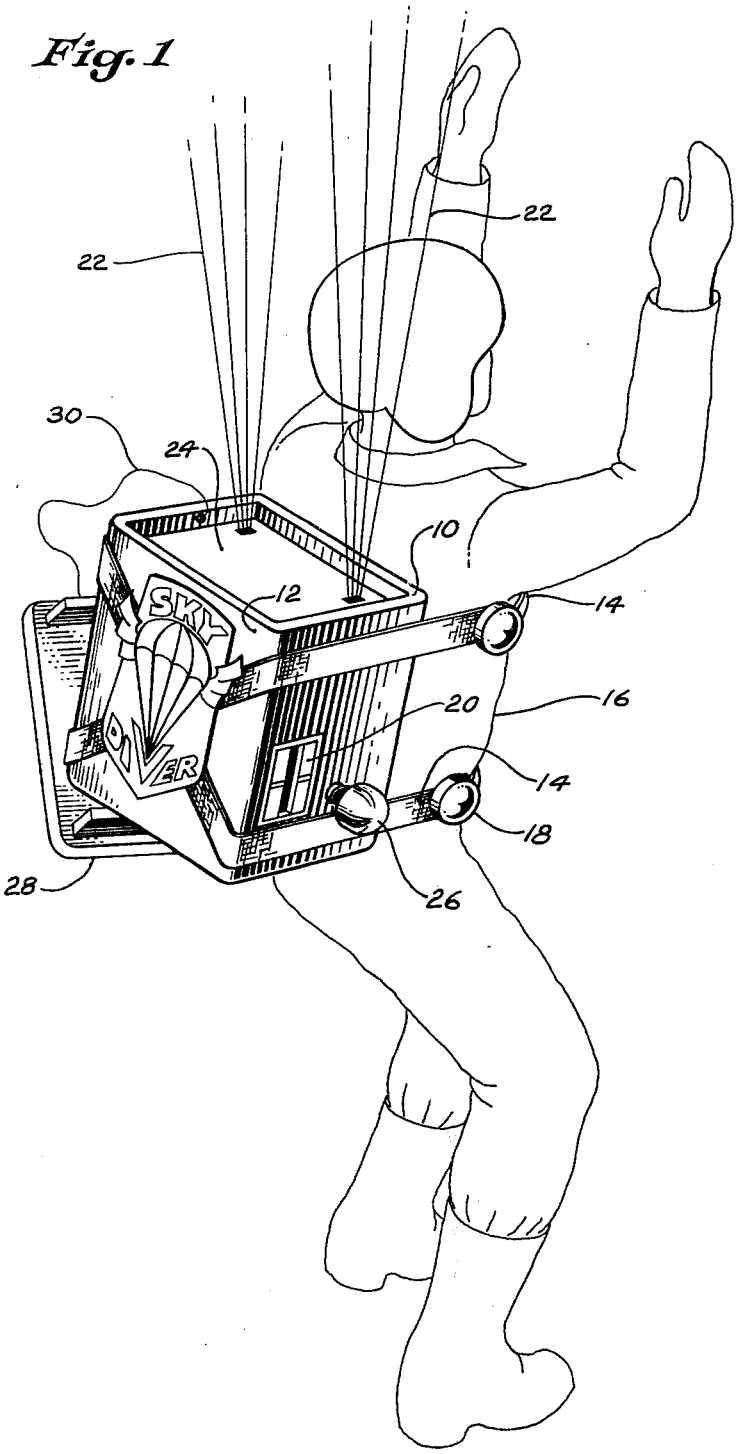
FIG. 1 is a perspective view of a toy figure with the parachute toy attached to it in a preferred manner, the parachute toy being partially shown in a deployed state.

While the parachute toy may be used by itself, it is designed and adapted to be used with a toy figure as shown in FIG. 1. Such an application not only best simulates action in real life, but it also provides a very appealing accessory for the many toy soldier figures that currently enjoy wide popularity.

The parachute toy includes a container 10 which may be enveloped in a cloth covering 12 and attached by semi-elastic straps 14 to a toy figure 16. Preferably each end of the straps terminate in a snap element 18 permitting the parachute toy to be readily attached about the figure, and the straps interconnect in front of the toy to form an X. Preferably the straps are somewhat elastic or resilient, permitting them to be adapted to a variety of toy figure sizes. A scale 20 is provided in the side of the container adjacent a window.

A parachute canopy (not shown) is attached by shroud lines 22 to the face of a drive piston 24 within the container near the toy figure side of the container to be approximately positioned over the center of gravity of the combined unit. A latch button 26 may be actuated causing the toy parachute to be ejected from the container by the drive piston, the ejection causing a lid 28 to "pop" from the top of the container, the lid being attached to the inside of the container by a string 30.

In a preferred embodiment for toy doll soldiers of conventional size, the parachute canopy should be approximately 30 inches in diameter and may be connected to the container by eight shrouds each approximately 20 inches in length. The container, because of the simple, rugged construction provided by this invention, need only be of a slightly larger volume than that required by the parachute, the container in the preferred embodiments being approximately 1¾ inches to 2 inches thick, 2¼ inches wide and 3 inches deep.

Since a great deal of the appeal of many toys is centered upon it moment of operation, it is preferred that the parachute toy rapidly deploy its parachute in a definite, vigorous action. To achieve such an operation in a simple, foolproof mechanism is indeed a challenge. Repeated tests of models confirm the success of the two embodiments subsequently described in achieving such a result, each producing a loud "pop" upon actuation.

Figure 2:
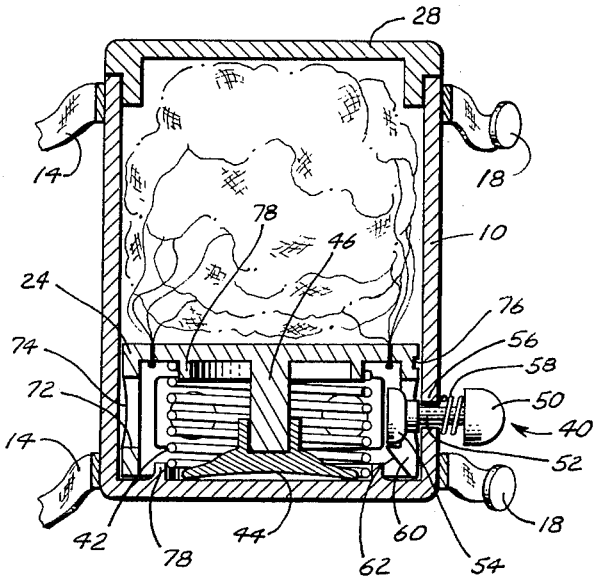
FIG. 2 is a view in vertical cross-section of one preferred embodiment of the parachute toy being illustrated in a loaded condition.
Figure 3:
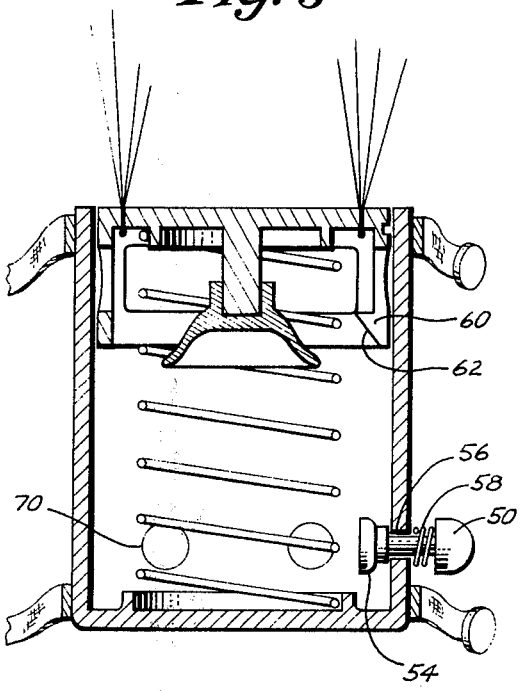
FIG. 3 is a view of the parachute toy shown in FIG. 2 but now in an actuated state.

One preferred embodiment is shown in a loaded condition in FIG. 2 and an actuated condition in FIG. 3. In this embodiment, the drive piston 24 is latched in a loaded state by a latching or triggering mechanism 40. In this state, a spring 42 is compressed between the undersurface of the drive piston and the base of the container. A suction cup 44 is received upon a stud 46 projecting from the center of the piston, and is positioned between the undersurface of the drive piston and the base of the container, the mouth of this suction cup being splayed out firmly against the base at full piston compression.

The latch mechanism 40 includes a latch knob 50 attached by shaft 52 to a latch element 54. Shaft 52 passes through an opening 56 in the side of the container and is biased in an outward direction by spring 58 compressed between the undersurface of the knob 50 and the side of the container.

The drive piston 24 includes a skirt that is shaped in the area surrounding the latching mechanism to provide a pair of teeth 60, one on each side of the latch shaft 52. Each tooth includes as its inner lower surface a ramp or face 62 which upon passing latch element 54 bears against its inner curved surface, camming the latch element inwardly. Upon depressing the drive piston to the position shown in FIG. 2, the upper, flat surface of each tooth 60 just passes the lower surface of the latch element 54 permitting spring 58 to drive the latch outwardly to the position shown, latching the drive piston in a loaded condition.

To use the parachute toy, the latch mechanism is simply actuated by depressing knob 50 causing latch element 54 to move past teeth 60. This permits drive spring 42 to force drive piston 24 upwardly a slight amount until suction cup 44 retards the upward movement. The suction grip of the cup to the base of the container inherently will release gradually, since its seal to the base of the container is not absolutely air tight. Its rate of release (the time it requires to trigger ejection) is determined to a large extent by the smoothness of the surface it grips, smoother surfaces providing greater delays to ejection. Indeed, dust or dirt may be added to reduce the delay, or the toy cleaned of such materials to increase the delay. As the hold of the suction cup releases, drive spring 42 pushes the drive piston up until finally the suction cup is fully released permitting spring 42 to drive the piston upwardly to the position shown in FIG. 3, this action deploying the parachute.

During this rapid upward movement ejecting the parachute, because of the close fit of the drive piston within the container, as is preferred, normally a vacuum would result under the drive piston that would retard its upward movement and the ejection action. To prevent such retardation, openings 70 are provided on the side of the container. These openings may be covered by a cloth envelope surrounding the container, the cloth filtering the air passing into the area under the piston. However, since the toy readily may be formed of molded plastic elements, preferably the container simply presents a molded cloth texture. Since openings 70 normally lie against the toy doll, they are adequately shielded from gross contamination. Preferably, the skirt of the drive piston is relatively deep to maintain the drive piston in an aligned state as it rapidly moves up within the container, and as it is compressed during loading by the user. Also, preferably relatively large areas of this skirt are removed to minimize friction of the skirt against the container, this removal not only including windows 72 and also outer portion of the web elements 74 which are carved away or bowed inwardly slightly as illustrated. In the arrangement shown in FIG. 2, there need be no added mechanism to prevent the drive piston from passing beyond the mouth of the container for spring 42, a cylindrical compression spring, will in addition limit the upward movement of the drive piston to the position shown in FIG. 3. Bosses 78 are provided about which the ends of the springs are fixed.

In the timed release mechanism shown in FIGS. 2 and 3, upon being actuated the drive piston will jump upwardly slightly, then gradually creep up an additional distance until the suction cup fully releases. This motion is indicated by a mark or pointer 76 that is provided on the side of the drive piston. This pointer moves along a slot or window in the container best shown in FIG. 1 adjacent scale 20. The position of the pointer along the scale will indicate quite accurately to an experienced user the time remaining before deployment of the parachute, permitting the user to time his throw and the force applied to cause the parachute to be deployed at the apogee of the toy's flight. The arrangement of the suction cup within the spring 42, and the use of a relatively small suction cup, results in a relatively small upward movement or creep of the drive piston as the suction cup releases. This in turn minimizes any tendency of the mechanism to begin to expel the parachute, or to force lid 28 from the container, during release of the suction cup. Accordingly, such an arrangement is preferred.

Figure 5:
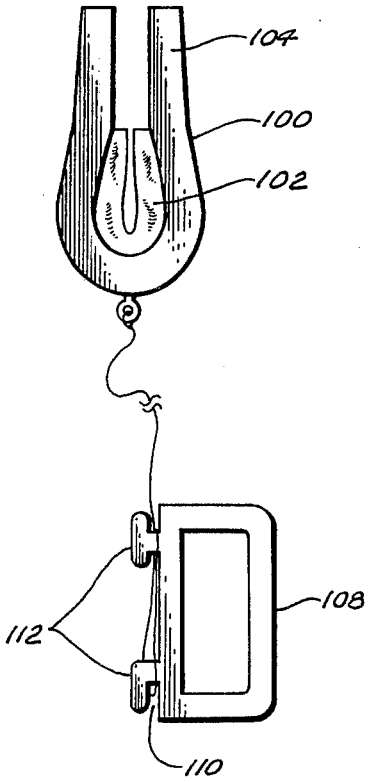
FIG. 5 is a plane view of a latch actuator.
Figure 4:
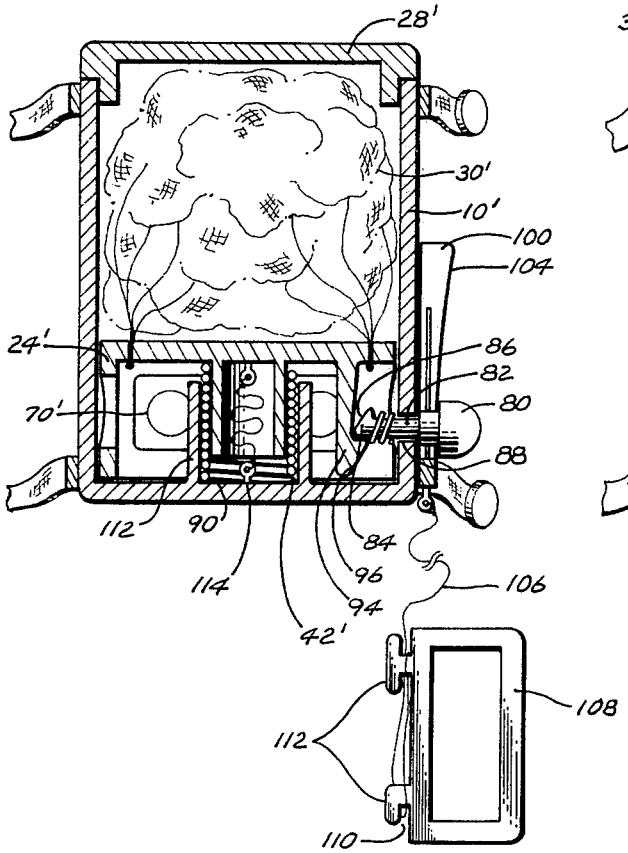
FIG. 4 is a view in a vertical cross-section of another embodiment of the parachute toy shown in a loaded state.
Figure 6:
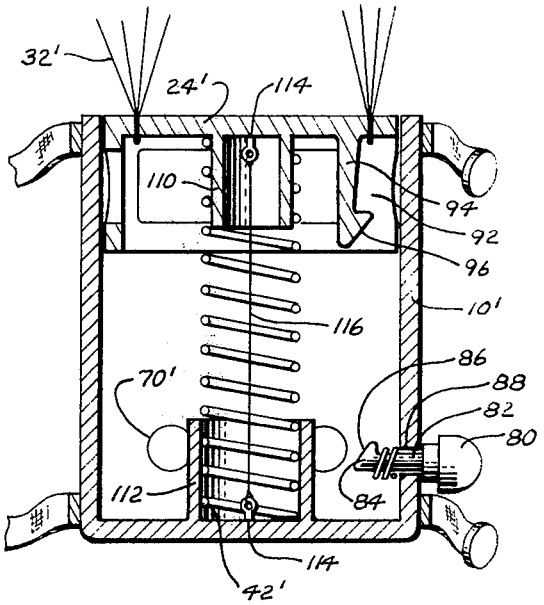
FIG. 6 is a view similar to FIG. 4 showing the parachute toy in an actuated state.

Another embodiment of the parachute toy is shown in FIGS. 4–6, in which similar elements are identified by primed reference characters. In this embodiment, the ejection mechanism provides a manual release of the triggering mechanism by means of a pull cord, the length of the cord being adjusted to actuate the parachute toy at approximately the apogee of its flight. To provide such a result, the latching mechanism includes a knob 80 connected by a shaft 82 to a latch element 84, the latch element including a ramp or face 86. The latch shaft passes through an opening 88 in the side wall of the container 10'. A compression spring 90 is provided between the inside face of the container and the latch element to bias the latch inwardly. Drive piston 24' includes the skirt portion lying adjacent to the latch element when the drive piston is in a loaded or compressed state, a channel 92 defined by wall element 94 the wall element including at its inward lower edge, a cam face 96 that bears against latch ramp or face 86. These cooperating surfaces cam the latch inwardly as the drive piston is compressed until, in its loaded state, the latch snaps behind face 96 and, in the position shown FIG. 4, holds the drive piston in the loaded state.

A U-shaped pull element 100, best shown in FIG. 5, is provided for being positioned about latch 80. This pull element incudes an enlarged opening about the base of the U, the opening being partially closed by a web 102. This web is sufficiently flexible that it will deform sufficiently upon being pressed about knob 80 to permit the knob to pass the web, the pull element thereby being positioned and held about the latch as shown in FIG. 4. The pull includes a ramp or face 104 of sufficient depth that when the pull is drawn past the latch, this face cams the underside of the latch knob 80 outwardly a distance sufficient to release drive piston 24'. Pull 100 is connected by a pull cord 106 to a D-ring 108. Preferably this D-ring is shaped to hold pull cord 106 wrapped about it as shown, the D-ring including a groove 110 for this purpose and elements or tabs 112, one tab being undercut at both ends to permit the string midsection to be wrapped about it a few times and friction locked in that position. Sufficient pull cord is provided to allow the parachute toy to be thrown upward a maximum distance, the length of the pull cord being adjusted about the D-ring to define this distance. Upon reaching the upward extent of its travel, the pull cord yanks pull 100 past knob 80 triggering the ejection action of the parachute toy. This triggering action will occur whatever position the toy happens to be in, for the pull will slide past the latch at any rotational orientation.

Drive piston 24' is powered by a compression spring 42' that may be received between a cylindrical wall 110 molded in the inner face of the drive piston and a similar wall 112 molded in the base of the container. Particularly if the spring is laterally quite flexible, these walls are useful and cooperate to contain and guide the drive spring as it is being compressed, preventing it from kinking in any direction. While the spring in this embodiment also may limit upward movement of the piston, eyelets 114 may be provided in adjacent faces of the drive piston and the base of the container, the eyelets being connected by a cord 116. The length of this cord defines the upward limit of movement of the drive piston, and is sufficient to permit the drive piston to pass only to the position shown in FIG. 6, a position at which it is substantially at the mouth of the container.

As will be apparent from the previous description of the operation of the parachute toy, upon being actuated by the latch, the drive piston is powered upwardly by the compression spring to pop the lid 28' from the mouth of the container and eject parachute 30', the parachute being attached to the drive piston by shroud lines 32'. The drive piston includes openings in its web similar to those provided in drive piston 24, and the container includes openings 70' in its side wall similar to those provided in container 10, these openings admitting air beneath the piston as it moves upwardly to prevent vacuum retardation of its motion.

While preferred embodiments of the parachute toy have been described, it will be apparent to those skilled in this art that modification in the various elements may be made without impairing the action of the resulting toy. Accordingly, the scope of the invention is defined by the following claims.

I claim:

1. A parachute toy including;

a container a piston within the container means to latch the piston within the container to provide a space for receiving a parachute and shroud lines;

a parachute attached to the container by shroud lines;

spring means to drive the piston within the container to eject the parachute and shroud lines from said space;

an air duct to vent air to the space vacated by the piston as it ejects the parachute to prevent vacuum retardation of the ejection action; and means to release the latch means whereby upon being latched and loaded with the parachute, the toy may be actuated to eject the parachute.

2. A parachute toy as set forth in claim 1 including straps means to attach the toy to a doll figure.

3. A parachute toy as set forth in claim 1 in which the latch means includes a suction cup between the piston and the container, the suction cup being splayed out against the container when the drive piston is in a position to receive the parachute within the container, the release means including a latch that holds the drive piston in a loaded condition until actuated, actuation of the latch permitting the spring means to move the drive piston upwardly slightly, the suction cup then retarding ejection of the parachute as it gradually releases its hold on the container under the urging of the spring means until finally its hold is broken and the spring means ejects the parachute.

4. A parachute toy as set forth in claim 3 in which the latch and drive piston include cooperating cam means to automatically latch and hold the drive piston upon its being compressed to a fully loaded state.

5. A parachute toy as set forth in claim 3 including indicator means attached to the drive piston, a channel in the side wall of the container to display this indicator means throughout its path of motion with the drive piston from a loaded to an actuated state whereby the status of the release of the drive piston is indicated externally. of the container by the indicator means.

6. A parachute toy as set forth in claim 5 including a latch and drive piston which include cooperating cam means to automatically latch and hold the drive piston upon its being compressed to a fully loaded state, the spring means being a compression spring received between the suction cup and the base of the container, with a guide pin in the base of the container about which the spring means is received and guided as it is compressed, the compression spring limiting movement of the drive piston outwardly relative to the container, a lid friction fit to the mouth of the container to close it and contain the parachute and shroud lines therein but to be forced from the container upon initiation of the ejection.

7. A parachute toy as set forth in claim 1 in which the latch means includes a pull element externally positioned about the latch and cooperating with the latch to provide said means for releasing the latch as the pull element is pulled from the latch, and a pull cord attached to the pull element for pulling the element from the latch whereby the user may hold the pull cord, thrown the parachute toy upwardly, the pull element actuating ejection of the parachute upon the toy reaching the elevation defined by the pull string.

8. A parachute toy as defined in claim 7 in which the latch interlocks with the drive piston in its loaded state to hold the drive piston in that position, the latch and drive piston including cooperating cam means to automatically interconnect the latch and drive piston as the piston is compressed to its fully loaded state.

9. A parachute toy as set forth in claim 8 including wall elements attached to the drive piston and the base of the container, said elements defining a channel for receiving the spring means there between, and means to limit the movement of the drive piston outwardly of the container to no greater a distance than defined by the mouth of the container.

10. A parachute toy as set forth in claim 8 including a D-ring, means attaching the other end of the pull cord to the D-ring, the D-ring including a channel in which the pull cord may be wrapped, the D-ring further including a tab about which a mid-portion of the pull cord may be wrapped, the tab holding the mid-section in this wrapped position.

* * * * *